US012624839B2

(12) United States Patent
Johnson

(10) Patent No.: US 12,624,839 B2
(45) Date of Patent: May 12, 2026

(54) COOKING APPLIANCE INCLUDING MULTIPLE HEATING ZONES AND METHODS FOR OPERATING THE SAME

(71) Applicant: Haier US Appliance Solutions, Inc., Wilmington, DE (US)

(72) Inventor: Eric Scott Johnson, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 405 days.

(21) Appl. No.: 18/494,506

(22) Filed: Oct. 25, 2023

(65) Prior Publication Data

US 2025/0137651 A1 May 1, 2025

(51) Int. Cl.
*F24C 7/08* (2006.01)
*F24C 3/12* (2006.01)
*F24C 15/32* (2006.01)

(52) U.S. Cl.
CPC ..... *F24C 7/085* (2013.01); *F24C 3/128* (2013.01); *F24C 7/087* (2013.01); *F24C 15/322* (2013.01); *F24C 15/325* (2013.01)

(58) Field of Classification Search
CPC ..... F24C 3/128; F24C 7/085; F24C 7/087; F24C 15/322; F24C 15/325
USPC ..... 126/19 R
See application file for complete search history.

(56) References Cited

U.S. PATENT DOCUMENTS 4,302,661 A 11/1981 Perry, Jr.
6,114,663 A 9/2000 Stockley
6,355,914 B1 3/2002 Stockley
6,777,652 B2 8/2004 Stockley
7,087,867 B2 8/2006 Stockley
7,372,000 B2 5/2008 Stockley
7,446,282 B2 11/2008 Shei et al.
7,766,003 B2 8/2010 Kim et al.
7,793,649 B2 * 9/2010 Barkhouse ..... F23N 1/002 126/41 R
8,138,453 B2 3/2012 Yang et al.
8,525,080 B2 9/2013 Ruther
8,669,500 B2 3/2014 Hensel et al.
8,748,783 B2 6/2014 Hensel et al.
8,878,106 B2 11/2014 Hensel et al.
10,064,244 B2 8/2018 Cheng et al.
10,085,592 B1 10/2018 Cheng
(Continued)

FOREIGN PATENT DOCUMENTS

JP H06235527 A 8/1994
JP 6006190 B2 10/2016
(Continued)

*Primary Examiner* — Steven B Mcallister
*Assistant Examiner* — Benjamin W Johnson
(74) *Attorney, Agent, or Firm* — Dority & Manning, P.A.

(57) ABSTRACT

A method of operating a cooking appliance including multiple cooking zones is provided. The method includes receiving a first temperature for a first zone and a second temperature for a second zone, determining a first heating pattern based on the first and second temperatures and the first and second zones, determining a second heating pattern based on one of the first or second temperatures, performing the first heating pattern, determining that the second temperature request has been canceled, and performing the second heating pattern after the second temperature request has been canceled.

20 Claims, 5 Drawing Sheets

(56) References Cited

U.S. PATENT DOCUMENTS

| | | | | |
|---|---|---|---|---|
| 10,223,933 | B1 | 3/2019 | Cheng et al. | |
| 10,502,430 | B1 | 12/2019 | Alvey et al. | |
| 11,116,348 | B2 | 9/2021 | Kwon et al. | |
| 11,175,048 | B2 | 11/2021 | Murad | |
| 11,672,050 | B2 | 6/2023 | Cheng et al. | |
| 2006/0289436 | A1 | 12/2006 | Carbone et al. | |
| 2007/0039945 | A1 | 2/2007 | Stockley | |
| 2010/0006561 | A1 | 1/2010 | Hensel et al. | |
| 2017/0017248 | A1 | 1/2017 | Armstrong et al. | |
| 2018/0295676 | A1 | 10/2018 | Cheng et al. | |
| 2019/0008320 | A1 | 1/2019 | Cheng | |
| 2019/0053332 | A1 | 2/2019 | Cheng et al. | |
| 2019/0086143 | A1 | 3/2019 | Liss et al. | |
| 2019/0139446 | A1 | 5/2019 | Cheng et al. | |
| 2020/0329909 | A1 | 10/2020 | Conrad et al. | |
| 2021/0095861 | A1* | 4/2021 | McKee | F24C 15/16 |
| 2021/0227647 | A1 | 7/2021 | Jeong et al. | |
| 2021/0231311 | A1 | 7/2021 | Ye et al. | |
| 2021/0353097 | A1 | 11/2021 | Jeong et al. | |
| 2021/0372630 | A1 | 12/2021 | Murad | |
| 2021/0401215 | A1 | 12/2021 | Kwon et al. | |
| 2022/0015572 | A1* | 1/2022 | Cottrell | F24C 15/04 |
| 2022/0046931 | A1 | 2/2022 | Iantorno et al. | |
| 2022/0065457 | A1 | 3/2022 | Bailey | |
| 2022/0065459 | A1 | 3/2022 | Murad | |
| 2022/0104654 | A1* | 4/2022 | Wild | G06V 20/00 |
| 2022/0151431 | A1* | 5/2022 | Lindsey | H05B 6/6447 |
| 2022/0163212 | A1 | 5/2022 | Mitrik et al. | |
| 2022/0163261 | A1* | 5/2022 | Cadima | F24C 15/008 |
| 2022/0186937 | A1 | 6/2022 | Murad | |

FOREIGN PATENT DOCUMENTS

| | | | |
|---|---|---|---|
| KR | 20050079522 | A | 8/2005 |
| KR | 100821745 | B1 | 4/2008 |
| KR | 20080095551 | A | 10/2008 |
| WO | WO2014041460 | A1 | 3/2014 |
| WO | WO2014044627 | A2 | 3/2014 |
| WO | WO2019068193 | A1 | 4/2019 |
| WO | WO2021098474 | A1 | 5/2021 |
| WO | WO2021195774 | A1 | 10/2021 |

* cited by examiner

COOKING APPLIANCE INCLUDING MULTIPLE HEATING ZONES AND METHODS FOR OPERATING THE SAME

FIELD OF THE INVENTION

The present subject matter relates generally to cooking appliances, and more particularly to multi-zone oven appliances and methods for operating the same.

BACKGROUND OF THE INVENTION

Oven appliances generally include a cabinet that defines a cooking chamber for cooking food items therein, such as by baking or broiling the food items. In order to perform the cooking operation, oven appliances typically include one or more heat sources, or heating elements, provided in various locations within the cooking chamber. These heat sources may be used together or individually to perform various specific cooking operations, such as baking, broiling, roasting, and the like.

Some oven appliances may be able to perform cooking operations on multiple food items simultaneously by allocating zones within the cooking chamber. However, current oven appliances are not able to determine, or may only approximate different cooking times or power levels of different food items placed in the cooking chamber. Accordingly, the cooking operations on multiple food items may lead to undercooked or overcooked foods, depending on what is being cooked, the state at which it is placed in the cooking chamber, and the accuracy of the cooking algorithms. Additionally, the addition or removal of food items may negatively impact the cooking operation.

Accordingly, a method of operating a cooking appliance that obviates one or more of these drawbacks would be beneficial. Particularly, a method of operating an oven appliance that is able to adjust cooking parameters according to the presence or absence of food items would be desirable.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a cooking appliance is provided. The cooking appliance may include a cabinet forming a cooking chamber, the cooking chamber defining a plurality of cooking zones therein; a plurality of heating elements provided within the cooking chamber, each of the plurality of heating elements being independently operated; a user interface configured to receive inputs; and a controller operably connected with the plurality of heating elements and the user interface, the controller configured to perform a cooking operation. The cooking operation may include receiving a first temperature request for a first cooking zone of the plurality of cooking zones via the user interface; receiving a second temperature request for a second cooking zone of the plurality of cooking zones via the user interface, the second cooking zone being different from the first cooking zone and the second temperature request being different from the first temperature request; determining a first heating pattern of the plurality of heating elements based on the first temperature request, the second temperature request, the first cooking zone, and the second cooking zone; determining a second heating pattern of the plurality of heating elements, the second heating pattern being based on the first temperature request and omitting the second temperature request; directing each of the plurality of heating elements according to the first heating pattern; determining that the second temperature request has been canceled after directing each of the plurality of heating elements according to the first heating pattern; and directing each of the plurality of heating elements according to the second heating pattern after determining that the second temperature request has been canceled.

In another exemplary aspect of the present disclosure, a method of operating a cooking appliance is provided. The cooking appliance may include a cooking chamber defining a plurality of cooking zones, a plurality of heating elements provided within the cooking chamber, and a user interface configured to receive inputs. The method may include receiving a first temperature request for a first cooking zone of the plurality of cooking zones via the user interface; receiving a second temperature request for a second cooking zone of the plurality of cooking zones via the user interface, the second cooking zone being different from the first cooking zone and the second temperature request being different from the first temperature request; determining a first heating pattern of the plurality of heating elements based on the first temperature request, the second temperature request, the first cooking zone, and the second cooking zone; determining a second heating pattern of the plurality of heating elements, the second heating pattern being based on the first temperature request and omitting the second temperature request; directing each of the plurality of heating elements according to the first heating pattern; determining that the second temperature request has been canceled after directing each of the plurality of heating elements according to the first heating pattern; and directing each of the plurality of heating elements according to the second heating pattern after determining that the second temperature request has been canceled.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
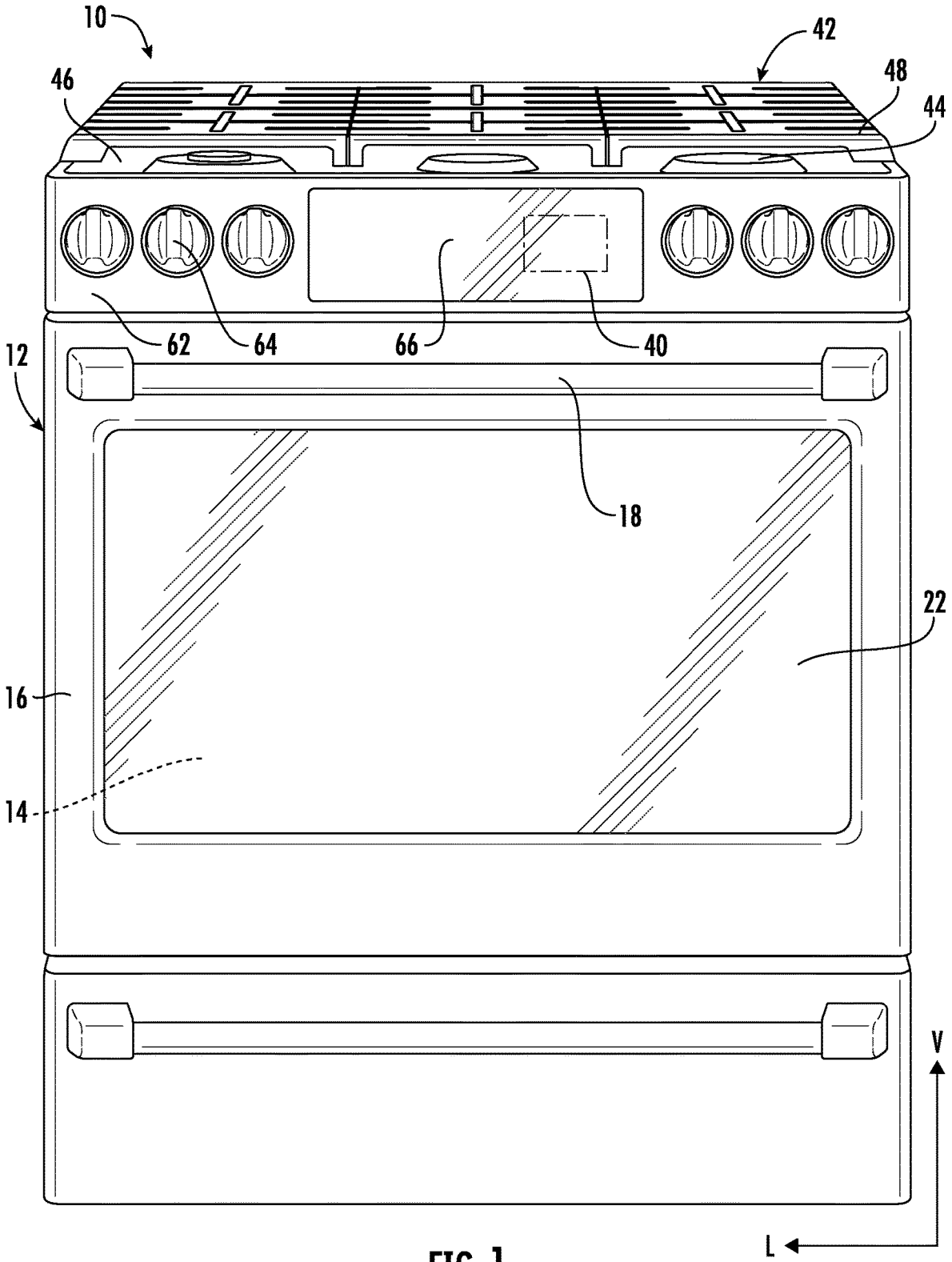
FIG. 1 provides a front view of an exemplary cooking appliance with the door in a closed position according to exemplary embodiments of the present disclosure.

Repeat use of reference characters in the present specification and drawings is intended to represent the same or analogous features or elements of the present invention.

DETAILED DESCRIPTION

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the terms "first," "second," and "third" may be used interchangeably to distinguish one component from another and are not intended to signify location or importance of the individual components. The terms "includes" and "including" are intended to be inclusive in a manner similar to the term "comprising." Similarly, the term "or" is generally intended to be inclusive (i.e., "A or B" is intended to mean "A or B or both"). In addition, here and throughout the specification and claims, range limitations may be combined and/or interchanged. Such ranges are identified and include all the sub-ranges contained therein unless context or language indicates otherwise. For example, all ranges disclosed herein are inclusive of the endpoints, and the endpoints are independently combinable with each other. The singular forms "a," "an," and "the" include plural references unless the context clearly dictates otherwise.

Approximating language, as used herein throughout the specification and claims, may be applied to modify any quantitative representation that could permissibly vary without resulting in a change in the basic function to which it is related. Accordingly, a value modified by a term or terms, such as "generally," "about," "approximately," and "substantially," are not to be limited to the precise value specified. In at least some instances, the approximating language may correspond to the precision of an instrument for measuring the value, or the precision of the methods or machines for constructing or manufacturing the components and/or systems. For example, the approximating language may refer to being within a 10 percent margin, i.e., including values within ten percent greater or less than the stated value. In this regard, for example, when used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

The word "exemplary" is used herein to mean "serving as an example, instance, or illustration." In addition, references to "an embodiment" or "one embodiment" does not necessarily refer to the same embodiment, although it may. Any implementation described herein as "exemplary" or "an embodiment" is not necessarily to be construed as preferred or advantageous over other implementations. Moreover, each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

Turning now to the figures, FIG. 1 provides a perspective view of a cooking appliance 10 according to exemplary embodiments of the present disclosure. Generally, cooking appliance 10 defines a vertical direction V, a lateral direction L, and a transverse direction T. The vertical direction V, lateral direction L, and transverse direction T are mutually perpendicular and form an orthogonal direction system. As will be understood, cooking appliance 10 is provided by way of example only, and the present subject matter may be used in any suitable appliance. Thus, the present disclosure may be used with other oven, range, or countertop appliance configurations (e.g., configurations that define multiple interior cavities for the receipt of food or are otherwise different than the configuration shown in FIG. 1), as well as other suitable appliances, as would be understood in light of the present disclosure.

Cooking appliance 10 may include an insulated cabinet 12 with an interior cooking chamber 14 defined by an interior surface of cabinet 12. Cooking chamber 14 is configured for the receipt of one or more food items to be cooked. Cooking appliance 10 includes a door 16 rotatably mounted to cabinet 12 (e.g., with a hinge—not shown). A handle 18 may be mounted to door 16 and may assist a user with opening and closing door 16 in order to access an opening to cooking chamber 14. For example, a user can pull on handle 18 to open or close door 16 and access cooking chamber 14 through the opening. As will be described below, one or more internal heating elements (e.g., baking, broiling, or convection heating elements) may be provided within cooking chamber 14 to cook or otherwise heat items therein.

Cooking appliance 10 may include a seal (not shown) between door 16 and cabinet 12 that assist with maintaining heat and cooking fumes within cooking chamber 14 when door 16 is closed, as shown in FIG. 1. One or more parallel glass panes 22 provide for viewing the contents of cooking chamber 14 when door 16 is closed and assist with insulating cooking chamber 14. Optionally, one or more baking racks may be positioned in cooking chamber 14 for the receipt of food items or utensils containing food items.

Cooking appliance 10 may include a cooktop surface 42 having one or more heating elements 44 for use in heating or cooking operations. In exemplary embodiments, cooktop surface 42 is comprised of a metal (e.g., steel) panel 46 on which one or more grates 48 may be supported. In other embodiments, however, cooktop surface 42 may be comprised of another suitable material, such as a ceramic glass or another suitable non-metallic material. Heating elements 44 may be various sizes, as shown in FIG. 1, and may employ any suitable method for heating or cooking an object, such as a cooking utensil (not shown), and its contents. In one embodiment, for example, heating element uses a heat transfer method, such as electric coils or gas burners, to heat the cooking utensil. In another embodiment, however, heating element 44 uses an induction heating method to heat the cooking utensil directly. In turn, heating element may include a burner element, electric heat element, induction element, or another suitable heating element.

Some embodiments of cooking appliance 10 include a controller 40 (e.g., configured to control one or more operations of cooking appliance 10). For example, controller 40 may control at least one operation of cooking appliance 10 that includes an internal heating element or cooktop heating element 44. Controller 40 may be in communication (via for example a suitable wired or wireless connection) with one or more of heating element(s) 44 and other suitable components of cooking appliance 10, as discussed herein. In general, controller 40 may be operable to configure cooking appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout cooking appliance 10. As illustrated, controller 40 may be located within a user interface 62 of cooking appliance 10. In some such embodiments, input/output ("I/O") signals may be routed between controller 40 and various operational components of cooking appliance 10, such as heating element(s) 44, control knobs 64, display component 66, sensors, alarms, or other components as may be provided. For instance, signals may be directed along one or more wiring harnesses that may be routed through cabinet 12. In some embodiments, controller 40 is in communication with user interface assembly 62 and control knobs 64 through which a user may select various operational features and modes and monitor progress of cooking appliance 10. In one embodiment, user interface assembly 62 may represent a general purpose I/O ("GPIO") device or functional block. In one embodiment, user interface assembly 62 may include input components, such as one or more of a variety of electrical, mechanical, or electro-mechanical input devices including rotary dials, push buttons, and touch pads. User interface assembly 62 may include a display component 66, such as a digital or analog display configured to provide operational feedback to a user.

While cooking appliance 10 is shown as a cooktop oven combination, the present invention could also be used with other cooking appliances such as, e.g., a stand-alone oven, an oven with a stove-top, or other configurations of such ovens. Numerous variations in the oven configuration are possible within the scope of the present subject matter. For example, variations in the type and/or layout of the user interface assembly 62, as mentioned above, are possible. As another example, cooking appliance 10 may include multiple doors 16 instead of or in addition to the single door 16 illustrated. Such examples include a dual cavity oven, a French door oven, and others. The examples described herein are provided by way of illustration only and without limitation.

User interface assembly 62 (e.g., display 66) may include one or more touch controls. For instance, display 66 may be a touch display (e.g., capacitive touch, proximity touch, pressure switch, etc.) capable of receiving touch inputs from a user relating to cooking operations. Additionally or alternatively, user interface assembly 62 may include one or more additional touch controls separate from display 66 that are capable of receiving touch inputs to control cooking appliance 10. User selections may then be displayed on display 66 to provide visual confirmation to the user of selections made. For instance, multiple selections may be made before initiating a particular cooking operation, as will be described in more detail below.

Figure 7:
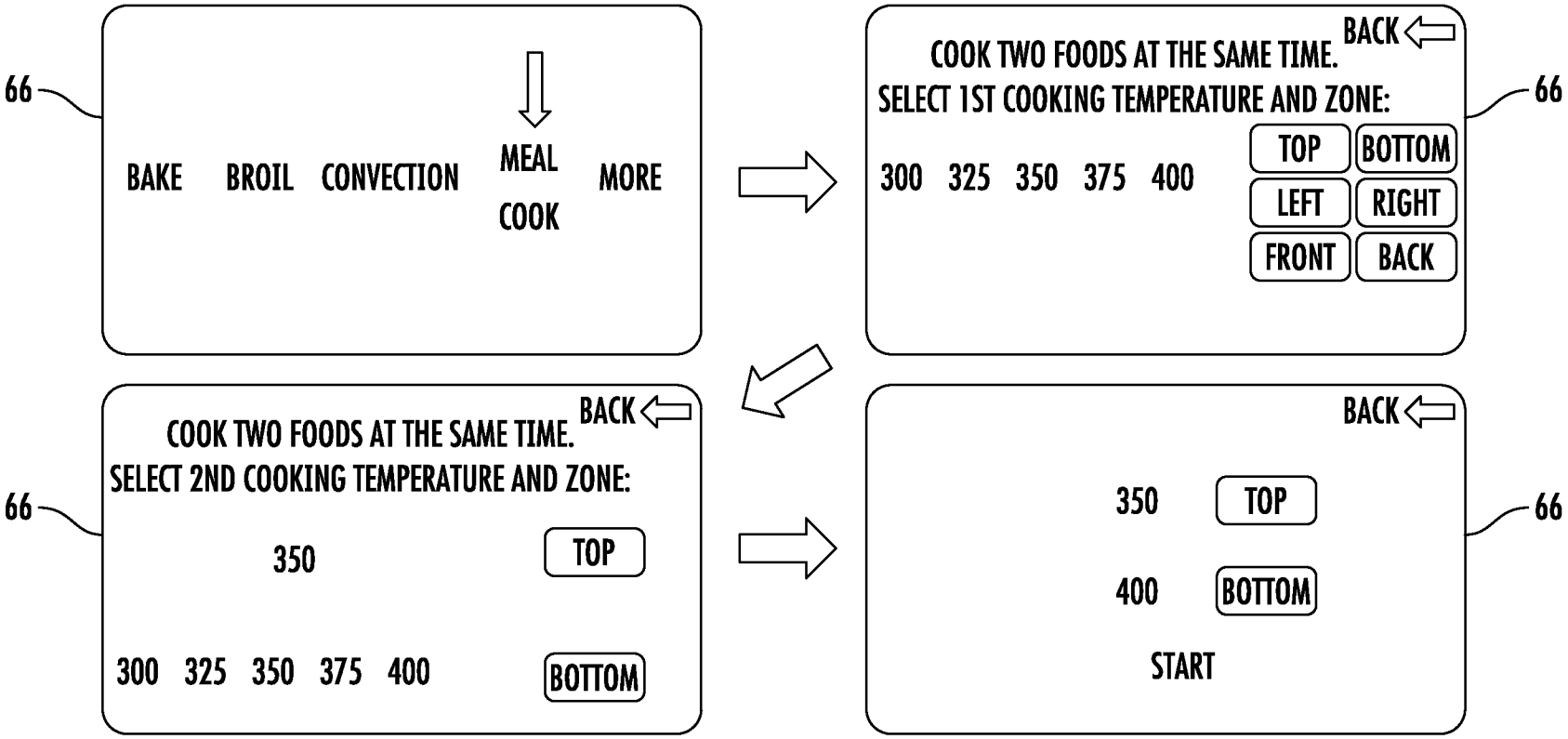
FIG. 7 provides a schematic representation of a display of the exemplary cooking appliance of FIG. 1.

According to some embodiments, cooking appliance 10 (e.g., within cooking chamber 14) is capable of cooking multiple items at different temperatures within cooking chamber 14. In detail, the cooking operation may receive a plurality of inputs (e.g., user inputs) relating to a plurality of cooking zones (described below) within cooking chamber 14. Accordingly, user interface assembly 62 may prompt a user to select a cooking mode to initiate the specified cooking operation. As shown in FIG. 7, display 66 may display a plurality of potential cooking modes for the user to select.

Figure 2:
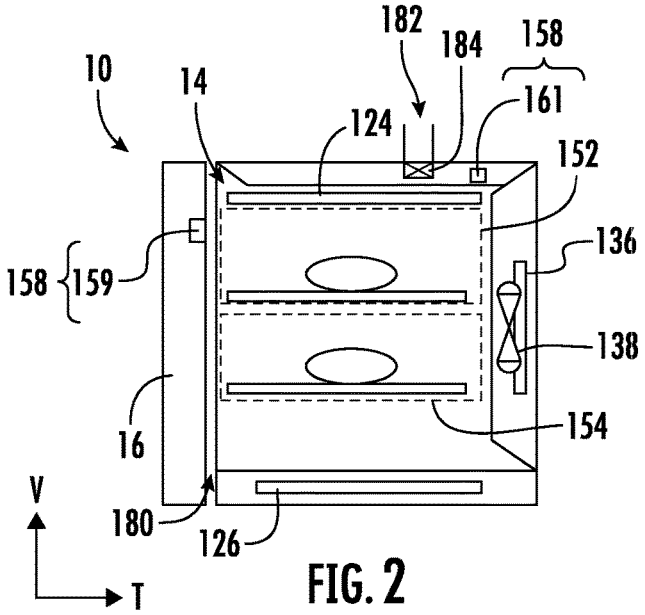
FIG. 2 provides a schematic side view representation of the cooking appliance of FIG. 1 illustrating multiple zones within a cooking chamber.

Referring now to FIGS. 2 through 5, various schematic representations of cooking chamber 14 are provided. As shown in FIG. 2, cooking chamber 14 may be divided into several distinct heating zones. For instance, cooking chamber 14 may include a first heating zone, or zone 1 152, and a second heating zone, or zone 2 154. It should be understood that any suitable number of heating zones may be incorporated into cooking chamber 14, including more than two heating zones. Each of the heating zones may be spaced apart from one another (e.g., along the vertical direction V, the lateral direction L, and/or transverse direction T). In other words, zone 1 152 may be spaced apart from zone 2 154, etc. Accordingly, each heating zone may be controlled separately from one another (e.g., to or at a different temperature or power level, using a different criterion, or using a different heating cycle).

Further, one or more heating elements may be provided at the top, bottom, or both of cooking chamber 14, and may provide heat to cooking chamber 14 for cooking. Such heating element(s) can be gas, electric, microwave, or a combination thereof. For example, in the embodiment shown in FIG. 2, cooking appliance 10 includes a top heating element 124 positioned at a top of cooking chamber 14 and a bottom heating element 126 positioned at a bottom of cooking chamber 14. Other configurations may be used as well. For instance, multiple top heating elements 124 and multiple bottom heating elements 126 may be incorporated.

Cooking appliance 10 may also have a convection heating element 136 and/or convection fan 138 (e.g., collectively a convection heating assembly) positioned adjacent a back wall 116 of cooking chamber 14. Convection fan 138 may be powered by a convection fan motor. Further, convection fan 138 may be a variable speed fan-meaning the speed of fan 138 may be controlled or set anywhere between and including, e.g., zero and one hundred percent (0%-100%). According to at least one example, convection fan 138 is provided as a stand-alone fan (e.g., without an accompanying convection heating element). In certain embodiments, cooking appliance 10 also includes a bidirectional triode thyristor (not shown), i.e., a triode for alternating current (TRIAC), to regulate the operation of convection fan 138 such that the speed of fan 138 may be adjusted during operation of cooking appliance 10. The speed of convection fan 138 may be determined by controller 40. In addition, a sensor such as, e.g., a rotary encoder, a Hall effect sensor, or the like, may be included at the base of fan 138 to sense the speed of fan 138.

The speed of fan 138 may be measured in, e.g., revolutions per minute ("RPM"). In some embodiments, the convection fan 138 may be configured to rotate in two directions, e.g., a first direction of rotation and a second direction of rotation opposing the first direction of rotation (see FIG. 6). For example, in some embodiments, reversing the direction of rotation, e.g., from the first direction to the second direction or vice versa, may still direct air from the back of cooking chamber 14. As another example, in some embodiments reversing the direction results in air being directed from the top and/or sides of cooking chamber 14 rather than the back of cooking chamber 14. Additionally or alternatively, an effective speed for convection fan 138 may be determined. The effective speed of fan 138 may include adjusting a rotational speed of the fan. Moreover, the effective speed may relate to a duty cycle of fan 138. For instance, an effective speed of fan 138 may incorporate a determined cycle of "ON' and "OFF" times (e.g., in addition to or apart from the rotational speed).

In various embodiments, more than one convection heater assembly, e.g., more than one convection heating element 136 and/or convection fan 138 may be provided. In such embodiments, the number of convection fans and convection heaters may be the same or may differ, e.g., more than one convection heating element 136 may be associated with a single convection fan 138. Similarly, top heating elements and/or bottom heating elements may be provided in various combinations, e.g., one top heating element with two or more bottom heating elements, two or more top heating elements 124, 126 with no bottom heating element, etc.

Cooking appliance 10 may include a cooking chamber vent or vent passageway. In detail, an ambient air inlet 180 may be defined within (or through) cabinet 12 of cooking appliance 10. Ambient air inlet 180 may be provided between door 16 and cooking chamber 14, for instance. According to at least some embodiments, ambient air inlet 180 is provided at or near a bottom of cabinet 12 (e.g., along the vertical direction V). Additionally or alternatively, ambient air inlet 180 may be provided naturally (e.g., through a gasket provided between door 16 and cabinet 12). Ambient atmospheric air (e.g., ambient air from a room in which cooking appliance 10 is provided) may selectively enter cooking chamber 14 via ambient air inlet 180. In some instances, a pressure difference between cooking chamber 14 and the ambient atmosphere may draw the ambient atmospheric air into cooking chamber 14. Additionally or alternatively, a door, flap, gate, skirt, or other movable physical element may be provided at ambient air inlet 180. Thus, ambient air inlet 180 may be selectively opened or closed according to an input (e.g., to a connected motor, for instance).

Cooking appliance 10 may further include a cooking chamber vent 182. Cooking chamber vent 182 may be defined within (or through) cabinet 12. For instance, cooking chamber vent 182 provides fluid communication between cooking chamber 14 and the ambient atmosphere. Heated air within cooking chamber 14 may be selectively discharged or vented to the ambient atmosphere via cooking chamber vent 182. For instance, cooking chamber vent passageway may be defined between ambient air inlet 180 and cooking chamber vent 182. Thus, ambient air (e.g., cooling air) may be cycled or urged from ambient air inlet 180 to cooking chamber vent 182 (e.g., through cooking chamber 14) to provide selective cooling to cooking chamber 14 or items (e.g., food items) provided therein. Additionally or alternatively, a door, flap, gate, skirt, or other movable physical element may be provided at cooking chamber vent 182. Thus, cooking chamber vent 182 may be selectively opened or closed according to an input (e.g., to a connected motor, for instance).

Cooking appliance 100 may include a cooling fan 184. Cooling fan 184 may be provided at or near cooking chamber vent 182. In at least some embodiments, cooling fan 184 is provided at a downstream end of cooking chamber vent 182 (e.g., an exhaust side). For instance, cooling fan 184 may be an axial fan provided along the cooking chamber vent passageway to selectively urge the air within cooking chamber 14 (e.g., air provided to cooking chamber 14 via ambient air inlet 180). Accordingly, cooling fan 184 may be in fluid communication with cooking chamber 14. Cooling fan 184 may be selectively activated to produce a venting phenomenon according to one or more inputs (e.g., manual inputs via user interface 62, automatic inputs related to a cooking chamber temperature against a temperature input, etc.).

Additionally or alternatively, cooling fan 184 may be a variable speed air handler capable of operating at a plurality of rotational speeds, as would be understood. For instance, cooling fan 184 may include a high speed setting and a low speed setting (among additional speed settings). The high speed setting may produce a first flow path of the cooking chamber vent passageway while the low speed setting may produce a second flow path of the cooking chamber vent passageway. Thus, the operational speed of cooling fan 184 may be selected according to the first temperature and first heating zone 152 (or second temperature and second heating zone 154). For instance, the operational speed of cooling fan 184 may be adjusted according to which heating zone requests the lower temperature.

As shown in FIG. 2, zone 1 152 may be defined within an upper half of cooking chamber 14 (e.g., along the vertical direction V) and zone 2 154 may be defined within a lower half of cooking chamber 14 (e.g., along the vertical direction V, beneath zone 1 152). In detail, zone 1 152 may encompass an entire upper half of cooking chamber 14 while zone 2 154 encompasses an entire lower half of cooking chamber 14. Each of zone 1 152 and zone 2 154 may be at least partially defined by one or more racks, for instance (e.g., provided along the lateral direction L and transverse direction T). Accordingly, a first cooking item (e.g., food item, cookware item, baking item, etc.) may be positioned within zone 1 152 while a second cooking item is positioned within zone 2 154. It should be noted that each of zone 1 152 and zone 2 154 may receive heat or be affected by each active heating element within cooking chamber 14.

Figure 3:
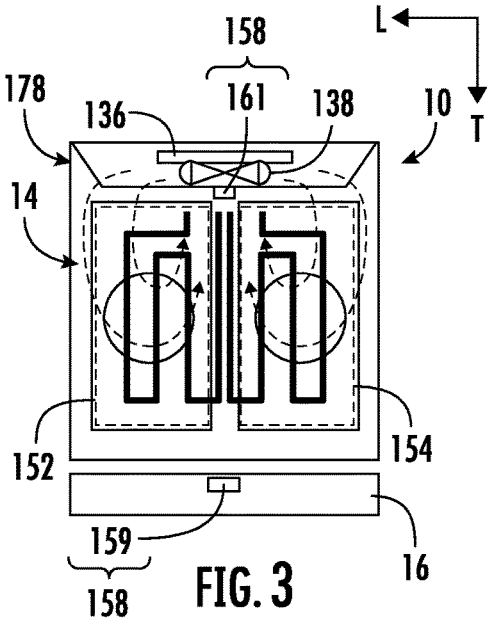
FIG. 3 provides a schematic top view representation of the cooking appliance of FIG. 1 illustrating multiple zones within the cooking chamber.
Figure 4:
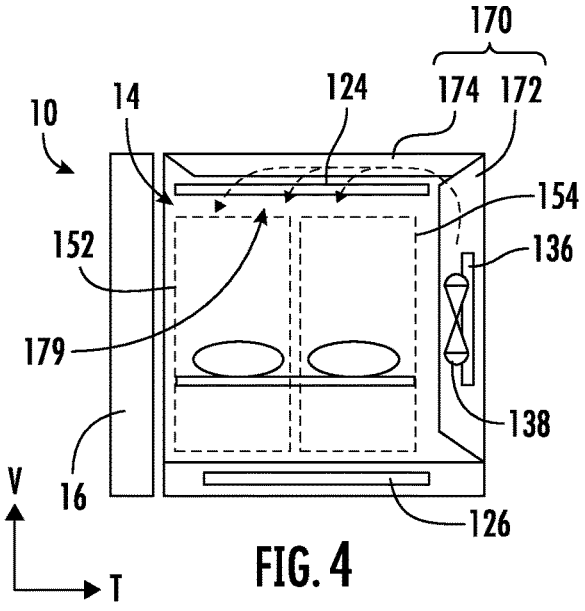
FIG. 4 provides a schematic side view representation of the cooking appliance of FIG. 1 illustrating multiple zones within the cooking chamber.

Similarly, with reference to FIG. 3, zone 1 152 may be defined within a first lateral side of cooking chamber 14 (e.g., a left side) and zone 2 154 may be defined within a second lateral side of cooking chamber 14 (e.g., a right side). According to this example, zone 1 152 encompasses an entire first lateral side of cooking chamber 14 (e.g., from a lateral midpoint of cooking chamber 14 to an inner wall of cooking chamber 14, from a top wall to a bottom wall, and from a back wall to door 16), while zone 2 154 encompasses an entire second lateral side of cooking chamber 14. For yet another example, with reference to FIG. 4, zone 1 152 may be defined within a front portion of cooking chamber 14 while zone 2 154 may be defined within a rear portion of cooking chamber 14. Thus, zone 1 152 may encompass an entire front half of cooking chamber 14 (e.g., from a transverse midpoint of cooking chamber 14 to door 16, from the top wall to the bottom wall, and from the first lateral side to the second lateral side) while zone 2 154 encompasses an entire rear half of cooking chamber 14. Additionally or alternatively, each of the plurality of cooking zones defined within cooking chamber 14 may be arbitrarily defined or selected by a user when initiating a joint cooking operation. For instance, the user may have an option to select an upper zone, a lower zone, a left zone, a right zone, a front zone, a back zone, a central zone, or the like.

Figure 5:
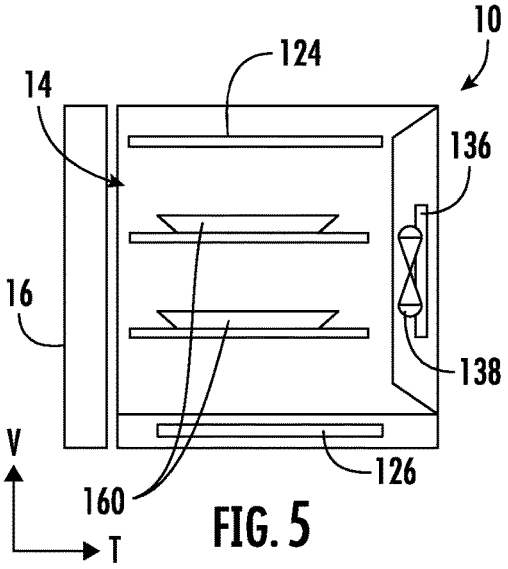
FIG. 5 provides a schematic side view representation of the cooking appliance of FIG. 1 illustrating multiple cookware items within the cooking chamber.

FIG. 5 provides an exemplary schematic view of cooking chamber 14 containing several cookware items. As shown, the cooking items provided within cooking chamber 14 (e.g., within each of first heating zone 152 and second heating zone 154) may have a predetermined size. For instance, each cookware item may occupy a certain percentage of the cooking rack on which they are supported. This in turn may affect an amount of heat (e.g., heat energy) is absorbed by the cookware item and transferred to the contents of the cookware item. Additionally or alternatively, each cookware item may have a unique finish exhibiting a number of specific attributes (e.g., color, reflectivity, texture, shade, etc.). For at least one example, cookware with a lighter color or shade (e.g., silver, white, mirrored, etc.) may reflect more heat or thermal energy (e.g., toward other cooking zones) and absorb less heat or thermal energy. Accordingly, cookware with a darker color or shade (e.g., black, brown, matte, etc.) may absorb more heat or thermal energy. As will be described below, certain operations may be adjusted according to the cookware attributes.

One or more sensors 158 may be provided within cooking chamber 14. The one or more sensors 158 may include, for instance, a camera 159. However, the one or more sensors 158 may include, in addition to or alternatively from the camera, an ultrasonic sensor, an infrared sensor, an optical sensor, or the like. Hereinafter, the one or more sensors 158 will be described with specific reference to a camera (e.g., camera 159). It should be understood that the information or data collected by camera 159 may be obtained through any suitable sensor, such as the aforementioned ultrasonic sensor or optical sensor.

Generally, camera 159 may be a video camera or a digital camera with an electronic image sensor [e.g., a charge coupled device (CCD) or a CMOS sensor]. When assembled, camera 159 is in communication (e.g., electric or wireless communication) with controller 40 such that controller 40 may receive a signal from camera 159 corresponding to the image captured by camera 159. Camera 159 may be configured to capture images of cooking chamber 14 (e.g., each of the plurality of cooking zones). For instance, camera 159 may capture images of food items placed in each of first heating zone 152, second heating zone 154, a third heating zone, or any additional heating zones. Camera 159 may be located in any suitable location within cooking chamber 14, such that each of first heating zone 152 and second heating zone 154 are visible to camera 159. For example, camera 159 may be located at or near a top of cooking chamber 14 along the vertical direction V. Additionally or alternatively, camera 159 may be located at or near a center of cooking chamber 14 along the lateral direction L. The specific location of camera 159 is not limited, however, and one of ordinary skill in the art would appreciate multiple potential locations for camera 159.

The image or images captured by camera 159 may be analyzed (e.g., within controller 40) to determine one or more attributes of a cookware item 160 within cooking chamber 14. For instance, camera 159 may capture an image of cookware item 160 (e.g., roasting pan, baking dish, cookie sheet, etc.) within first heating zone 152. The image may be analyzed to determine certain features of cookware item 160. For instance, the analysis may determine a material, an emissivity, a surface texture, a color, a size, a shape, or the like of the cookware item. Such features may selectively alter a heating rate of the items (e.g., food items) within cooking chamber 14. For instance, the attributes of cookware item 160 may affect thermal energy transfer of each of a first food item provided within first heating zone 152 and a second food item provided within second heating zone 154.

The one or more sensors may additionally include a temperature sensor 161. For instance, a single temperature sensor 161 may be provided within cooking chamber 14. Temperature sensor 161 may be positioned, for example, on a back wall, upper wall, or side wall of cooking chamber 14. Temperature sensor 161 may sense (e.g., selectively, continuously) a temperature within cooking chamber 14 (e.g., at predetermined intervals). Additionally or alternatively, temperature sensor 161 may transmit the sensed temperatures to controller 40.

As used herein, "temperature sensor" or the equivalent is intended to refer to any suitable type of temperature measuring system or device positioned at any suitable location for measuring the desired temperature. Thus, for example, the temperature sensor may be any suitable type of temperature sensor, such as a thermistor, a thermocouple, a resistance temperature detector, a semiconductor-based integrated circuit temperature sensors, etc. In addition, the temperature sensor may be positioned at any suitable location and may output a signal, such as a voltage, to a controller that is proportional to and/or indicative of the temperature being measured. Although exemplary positioning of temperature sensors is described herein, it should be appreciated that appliance 10 may include any other suitable number, type, and position of temperature, humidity, and/or other sensors according to alternative embodiments.

Figure 6:
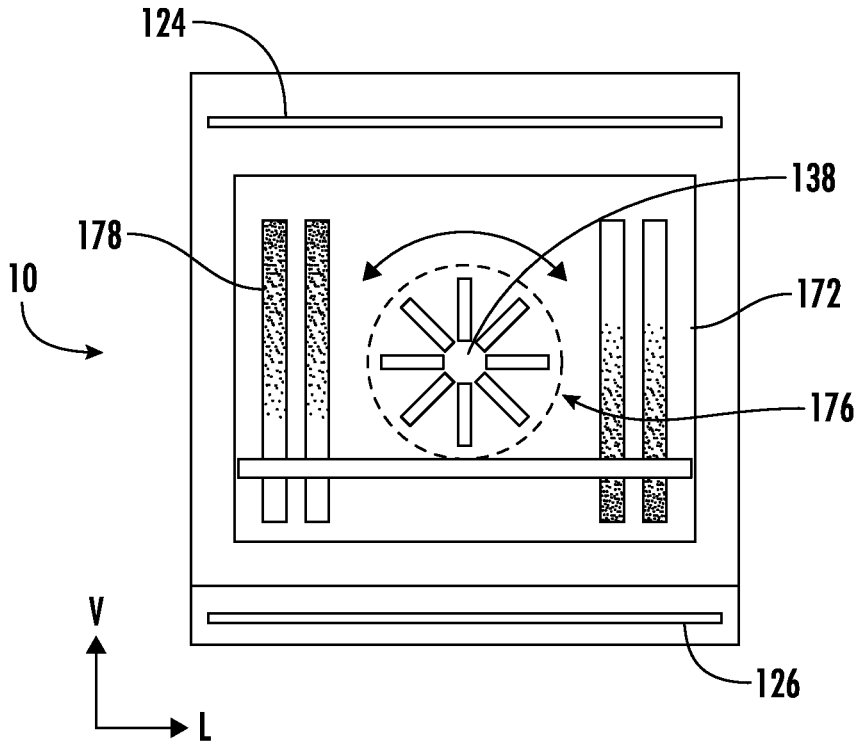
FIG. 6 provides a schematic front view representation of the cooking appliance of FIG. 1 illustrating a convection fan.

FIG. 6 provides a front schematic view of cooking chamber 14, specifically convection fan 138. In detail, cooking appliance 10 may include a duct system 170. Duct system 170 may be in fluid communication with cooking chamber 14. For instance, duct system 170 may be provided within cabinet 12 adjacent to cooking chamber 14. Duct system 170 may define a passageway through which convection air (e.g., as motivated by convection fan 138) flows. Accordingly, air or heated air within cooking chamber 14 may be routinely or continuously cycled through cooking chamber 14 to perform a convection style heating or cooking operation.

Duct system 170 may include a rear duct 172 and a top duct 174. Rear duct 172 may be provided at a rear of cabinet 12 (e.g., along the transverse direction T). For instance, rear duct 172 may define a height (along the vertical direction V) and a width (along the lateral direction L) that is substantially similar to a height and width of cooking chamber 14. In some embodiments, the height and width of rear duct 172 are between about 5% and about 20% smaller than the height and width of cooking chamber 14. Accordingly, the air circulated by convection fan 138 may be discharged from rear duct at or near peripheral edges of rear duct 172 (e.g., lateral edges, a top edge, etc.).

Convection heating assembly (e.g., convection heating element 136 and/or convection fan 138) may be provided within rear duct 172. As shown in FIG. 6, for instance, convection fan 138 may be located at or near a center (e.g., along the lateral direction L and vertical direction V) of rear duct 172. In some embodiments, convection fan 138 is provided closer to a bottom of rear duct 172 (e.g., along the vertical direction V). Additionally or alternatively, as mentioned above, convection fan 138 may be provided as a stand-alone circulation fan within rear duct 172 (e.g., omitting convection heating element 136).

Duct system 170 may define an intake 176 through which air from cooking chamber 14 is supplied to convection fan 138. In detail, intake 176 may be defined in rear duct 172. Intake 176 may be formed as an opening or series of openings (e.g., louvers) within rear duct 172. For instance, intake 176 may be defined such that an axial flow of air from cooking chamber 14 is provided along the transverse direction T (e.g., from front to back). Accordingly, air from cooking chamber 14 may be suctioned along the transverse direction T from cooking chamber 14 into rear duct 172.

Duct system 172 may include or define at least one exhaust outlet. In detail, the at least one exhaust outlet may include a pair of side exhaust outlets 178. Referring briefly to FIG. 3, the pair of side exhaust outlets 178 may be defined at lateral edges (or sides) of rear duct 172. Accordingly, convection air (e.g., as circulated by convection fan 138) may be motivated into cooking chamber 14 via one or both of the pair of side exhaust outlets 178. Additionally or alternatively, each of the pair of side exhaust outlets 178 may extend along the vertical direction V. For instance, each of the pair of side exhaust outlets 178 may include one or more openings or louvers extending predominantly along the vertical direction V. An extending length of each of the pair of side exhaust outlets 178 may vary according to specific embodiments. For one example, the openings or louvers of the side exhaust outlets 178 extend between about 60% and about 80% of a total height (e.g., along the vertical direction V) of rear duct 172.

Top duct 174 may be fluidly connected with rear duct 172. For instance, top duct 174 may be integrally formed with rear duct 172. Thus, air motivated by convection fan 138 may circulate from rear duct 172 to top duct 174 (e.g., according to specific embodiments, input parameters, etc.). Top duct 174 may extend along the transverse direction T from a top of rear duct 172 toward a front of cooking chamber 14. In some embodiments, top duct 174 extends an entire length (e.g., along the transverse direction T) of cooking chamber 14. Additionally or alternatively, top duct 174 may extend along the lateral direction L. For instance, a width of top duct 174 along the lateral direction may be substantially a width of cooking chamber 14 along the lateral direction L.

The at least one exhaust outlet may include a top exhaust 179. Top exhaust 179 may be defined in the top duct 174. For instance, with brief reference to FIG. 4, top exhaust 179 may be provided at or near a bottom of top duct 174 (e.g., facing cooking chamber 14). Accordingly, air exhausted into cooking chamber from top duct 174 may be motivated in a downward direction (e.g., along the vertical direction V). Top exhaust 179 may include one or more openings or louvers extending predominantly along the transverse direction T. An extending length of top exhaust 179 may vary according to specific embodiments. For one example, the openings or louvers of top exhaust 179 extend between about 60% and about 80% of a total depth (e.g., along the transverse direction T) of top duct 174. Additionally or alternatively, the openings or louvers of top exhaust 179 may extend between about 60% and about 80% of a total width (e.g., along the lateral direction L) of top duct 174.

Referring now to FIG. 7, an exemplary selection process for initiating the joint cooking operation will be described. In detail, the user may select (e.g., via user interface assembly 62) the joint cooking operation. In the embodiment shown, the joint cooking operation is referred to as "Meal Cook," however any suitable reference may be used to indicate performing a cooking operation on multiple items requiring different temperatures within cooking chamber 14. User interface assembly 62 (e.g., display 66) may present the user with an option to select a first temperature. The temperature options may be provided to the user in predetermined increments (e.g., 10 degree increments, 25 degree increments, etc.). Optionally, the user may enter a custom temperature for the first temperature.

The first temperature may be associated with a first heating zone or cooking zone (or, in some instances, a first food item). The first temperature may thus be a temperature at which the first cooking zone (e.g., and/or the first food item) must or should be cooked. The first temperature may be an average temperature that the first cooking item should be exposed to (e.g., within cooking chamber 14). As described, the first cooking item may be a food item, a cookware item, a bake item, or the like. For instance, the first temperature may be a set temperature within cooking chamber 14 (e.g., within first heating zone 152) at which the first cooking item should be heated.

The user may select a zone (e.g., a heating zone such as first heating zone 152, second heating zone 154, etc.) with which the first temperature will be associated. The user may be presented with a plurality of potential zones. As shown in FIG. 6, the zone options may include a top zone, a bottom zone, a left zone, a right zone, a front zone, or a back zone. Additional or alternative zones may be suggested, however, and the disclosure is not limited to the examples given herein. In some instances, a user may define a custom zone within cooking chamber 14.

The user may then select a second temperature and a second zone (e.g., either concurrently or separately). For instance, upon selecting the first temperature and the first zone, display 66 may present options for the second temperature and the second zone. The options for the second temperature may be limited and may be dependent on the first temperature. For instance, the possible selections for the second temperature may be limited to a range surrounding the first temperature. According to at least one example, if a user selects 350° F. for the first temperature, the options for the second temperature are limited to a range where 350° F. is the midpoint. The range may be a predetermined amount above and below the first temperature. For the example given above, the range may be between 300° F. and 400° F. The range may vary according to specific embodiments, however. Additionally or alternatively, upon selecting the first zone, cooking appliance 10 may automatically select the second zone to be complementary to the first zone. For example, if the top zone is selected as first heating zone 152, the bottom zone is automatically selected as the second heating zone 154.

Figure 8:
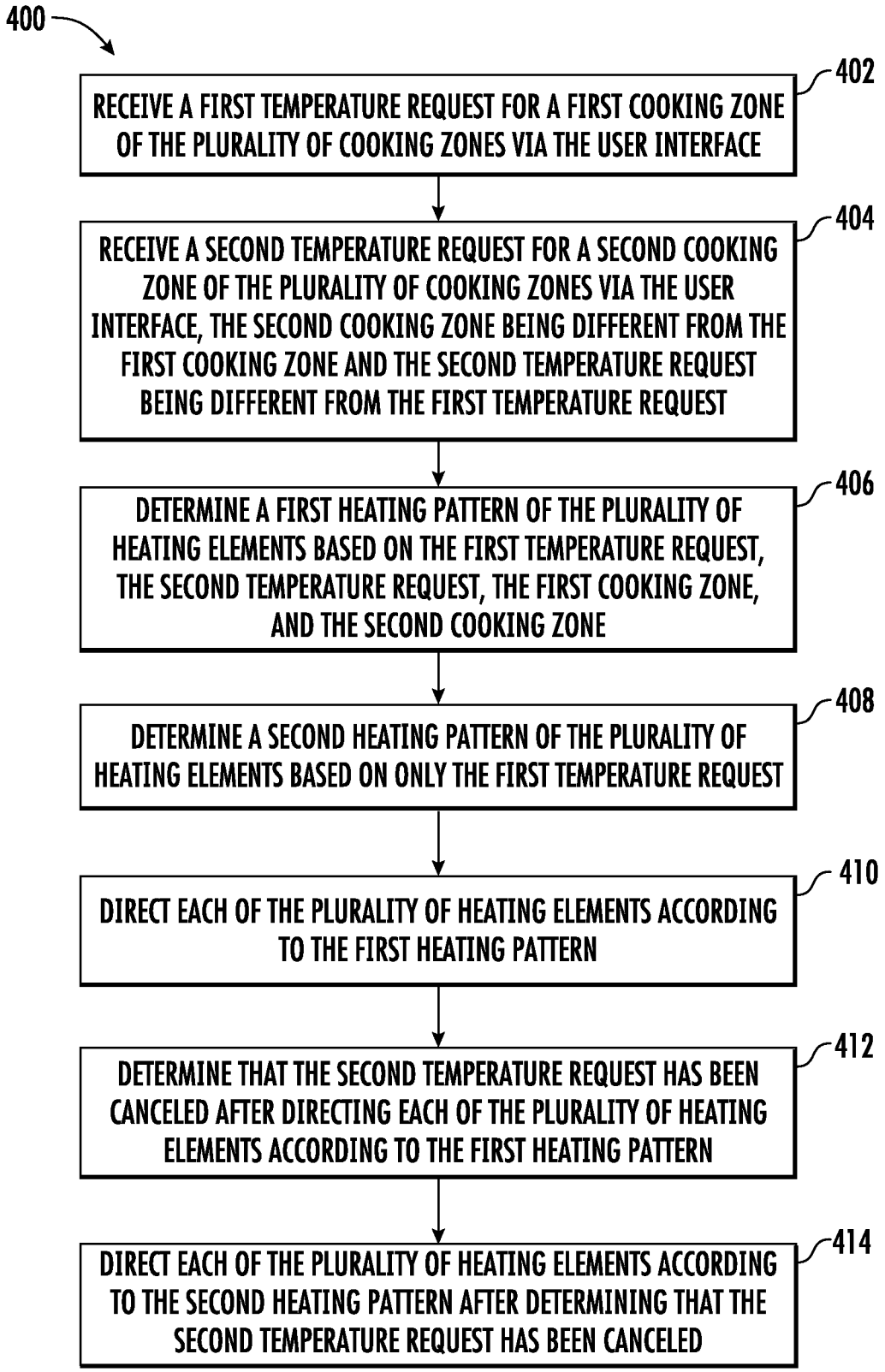
FIG. 8 provides a flow chart illustrating a method of operating a cooking appliance according to exemplary embodiments of the present disclosure.

Now that the general descriptions of an exemplary appliance have been described in detail, a method 400 of operating an appliance (e.g., cooking appliance 10) will be described in detail. Although the discussion below refers to the exemplary method 400 of operating cooking appliance 10, one skilled in the art will appreciate that the exemplary method 400 is applicable to any suitable domestic appliance capable of performing a cooking operation (e.g., such as a cooktop appliance, a stand-alone oven, etc.). In exemplary embodiments, the various method steps as disclosed herein may be performed by controller 40 and/or a separate, dedicated controller. FIG. 8 provides a flow chart illustrating a method of operating a cooking appliance. Hereinafter, method 400 will be described with specific reference to FIG. 8.

At step 402, method 400 may include receiving a first temperature request for a first cooking (e.g., heating) zone of a plurality of cooking zones via the user interface. For instance, as described above, a user may initiate a cooking operation (e.g., a joint cooking operation) by selecting a first temperature at which a first item is to be cooked. The first temperature may be associated with a first cooking zone. The first cooking zone may be selected together with the first temperature, as mentioned above.

At step 404, method 400 may include receiving a second temperature request for a second cooking (e.g., heating) zone of the plurality of cooking zones via the user interface. In detail, the second cooking zone may be different from the first cooking zone. As described above, the first cooking zone may be the top zone within a cooking chamber (e.g., cooking chamber 14), while the second cooking zone is the bottom zone within the cooking chamber. Moreover, the second temperature request may be different from the first temperature request. For instance, the second temperature request may be higher or lower than the first temperature request (e.g., by a predetermined amount). As discussed above, the second temperature request may be bound by an upper limit and a lower limit with regard to the first temperature request.

At step 406, method 400 may include determining a first heating pattern of the plurality of heating elements based on the first temperature request, the second temperature request, the first cooking zone, and the second cooking zone. In detail, upon determining the first temperature and zone and the second temperature and zone, the cooking appliance (e.g., via a controller therein) may determine, extrapolate, or otherwise calculate a first heating pattern to simulate the requested temperatures within the requested zones. The first heating pattern may include operations of each of a plurality of heating elements provided within the cooking chamber (e.g., top heating element 124, bottom heating element 126, convection heating element 136, convection fan 138, etc.). The first heating pattern may thus determine specific operational attributes of each of the heaters, including power levels, cycle times, cycle lengths, fan times, cycle repetition, or the like.

For one example, the top zone is the first selected zone at a temperature request of 400° F., and the bottom zone is the second selected zone at a temperature of 350° F. The first heating pattern may thus determine that the top zone should receive more heat or thermal energy than the bottom zone. The first heating pattern may include operating or directing the top heating element at a higher power level than the bottom heating element. Additionally or alternatively, the top heating element may be cycled more often than the bottom heating element. For instance, each of the top heater (e.g., a broil heater) and the bottom heater (e.g., a bake heater) may selectively operate at one or more predetermined duty cycles. According to the determined first heating pattern, the duty cycle of each of the top heater and bottom heater may be adjusted to simulate the requested temperatures. Additionally or alternatively, as mentioned above, a size, shape, color, finish, or other attribute of a cookware item detected within the cooking chamber (e.g., within a particular zone) may influence the determined first heating pattern.

The first heating pattern may include a cooking operation heating pattern as well as a preheat heating pattern. In detail, the determined first heating pattern may adjust the operational attributes (e.g., power level, duty cycle) of each of the heating elements during each of a preheat phase (e.g., warming up the cooking chamber) and a cooking phase (e.g., performing the cooking operation). For instance, the first heating pattern may adjust a power level of the top heater during the preheat phase to generate more heat at or near the top zone before any item is placed into the cooking chamber.

A third or other additional heater may be adjusted according to the determined first heating pattern. For instance, the convection heating assembly (e.g., convection heater 136 and convection fan 138) may be powered at a determined power level or duty cycle. Accordingly, air within cooking chamber may be cycled in specific manners or patterns to drive warmer air toward the zone with the higher requested temperatures. In some embodiments, exhaust of the convection air is determined according to a specific vent or exit depending on which zone has a higher requested temperature. In one example, the convection air is exhausted from a top of the cooking chamber when the top zone temperature is higher than a bottom zone temperature.

At step 408, method 400 may include determining a second heating pattern of the plurality of heating elements. For instance, the second heating pattern may be different from the first heating pattern. The second heating pattern may be based on only one of the first temperature request or the second temperature request. In detail, the second heating pattern may include one or more settings, adjustments, parameters, or other attributes of each of the heating elements based on a single temperature as opposed to two or more temperatures. For instance, the second heating pattern may include operations of each of the plurality of heating elements provided within the cooking chamber (e.g., top heating element 124, bottom heating element 126, convection heating element 136, convection fan 138, etc.). The second heating pattern may thus determine specific operational attributes of each of the heaters, including power levels (e.g., second power levels), cycle times (e.g., second cycle times), cycle lengths (e.g., second cycle lengths), fan times (e.g., second fan times), power ratios (e.g., second power ratios), cycle repetition, or the like.

The second heating pattern may be referred to as a single zone heating pattern. The second heating pattern may be determined at any stage during or before the initiation of the cooking operation. For instance, when the first temperature request is input to the appliance, the second heating pattern may develop, calculate, formulate, or otherwise determine the second heating pattern based on the first temperature request. Similarly, when the second temperature request is input to the appliance, the second heating pattern may develop, calculate, formulate, or otherwise determine the second heating pattern based on the second temperature request.

At step 410, method 400 may include directing each of the plurality of heating elements according to the first heating pattern. For instance, upon determining the heating pattern in response to receiving the first temperature request and zone selection and second temperature request and zone selection, the cooking operation (e.g., joint cooking operation) may be initiated. Each of the heating elements required to perform the cooking operation (e.g., to simulate the requested temperatures within the requested zones) may be directed accordingly throughout the preheat phase and the cooking phase. Advantageously, multiple different temperatures may be simulated within a single cooking chamber to perform different heating operations on multiple items provided within the cooking chamber. Accordingly, total heating times may be reduced by eliminating the need for single heating operations to be performed in series.

According to some additional embodiments, method 400 may include adjusting a determined temperature at which the oven appliance transitions from the preheat phase to the cook phase. For instance, in order to achieve the different effective temperatures within each respective cooking or heating zone, the method may determine a proper time for the cooking operation to switch from the preheat phase to the cook phase, which may include adjusting a power output, duty cycle, or power ratio of each of the heating elements. Additionally or alternatively, the method may include adjusting a target temperature (e.g., within the cooking chamber as sensed by the temperature sensor) to which the oven appliance (e.g., the plurality of heating elements) is tasked to maintain. Accordingly, adjusting a target temperature of the cooking chamber (e.g., a target temperature within at least one of the plurality of cooking or heating zones) may be incorporated to effectively simulate the two different requested temperatures.

At step 412, method 400 may include determining that the second temperature request has been canceled. Alternatively, method 400 may include determining that the first temperature request has been canceled. For instance, after directing each of the plurality of heating elements according to the first heating pattern (e.g., for a predetermined amount of time), one of the first temperature request or the second temperature request may be canceled. For sake of brevity, an exemplary case where the second temperature request is canceled will be described in detail with the understanding that the description can apply to an instance where the first temperature request is canceled.

In determining that the second temperature request has been canceled, method 400 may determine that the cooking item (e.g., food item) has been removed from the cooking chamber (e.g., from the second cooking or heating zone). In detail, one or more sensors (e.g., sensor 158) may detect, sense, or otherwise determine that the item has been removed from the cooking chamber. For one example, a camera (e.g., camera 159) is triggered to capture an image of the cooking chamber. The camera may be triggered by an opening and closing of the oven door. The captured image may then be analyzed to detect a presence or absence of items in either or both of the first zone and the second zone. One or more additional sensors may be utilized to determine that the second temperature request has been canceled, such as an ultrasonic sensor, a weight sensor, an infrared sensor, or the like.

Additionally or alternatively, the user may provide an input to the appliance indicating that the second temperature request has been canceled (e.g., the second item has been removed from the cooking chamber). For instance, a prompt may be presented (e.g., via the user interface). When the oven door is opened, the prompt may be displayed on the user interface. The prompt may include an option to select which item (if any) has been removed from the cooking chamber. Thus, the user may select which item has been removed.

At step 414, method 400 may include directing each of the plurality of heating elements according to the second heating pattern. For instance, after determining that the second temperature request has been canceled (e.g., the second item has been removed from the second zone of the cooking chamber), the heating elements may be adjusted according to the second heating pattern. Thus, the single temperature zone heating operation may be performed. During the second heating pattern, a remaining cook time of, e.g., the first food item may be easily performed according to the single temperature zone.

According to some embodiments, method 400 may include determining a transition heating pattern. In detail, the transition heating pattern may include transitional (or third) settings for the plurality of heating elements. The transitional setting may include transitional power levels, transitional power ratios, transitional duty cycles, or the like. The transitional heating pattern may be performed before the second heating pattern. For example, if the difference between the first (e.g., multi-zone) heating pattern varies from the second (e.g., single zone) heating pattern by a predetermined amount (e.g., in degrees), the transition heating pattern is instituted to safely, quickly, or efficiently transition the cooking chamber from the first heating pattern to the second heating pattern. Thus, method 400 may include directing each of the plurality of heating elements according to the determined transition heating pattern.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooking appliance comprising:

a cabinet forming a cooking chamber, the cooking chamber defining a plurality of cooking zones therein;

a plurality of heating elements provided within the cooking chamber, each of the plurality of heating elements being independently operated;

a user interface configured to receive inputs; and a controller operably connected with the plurality of heating elements and the user interface, the controller configured to perform a cooking operation, the cooking operation comprising:

receiving a first temperature request for a first cooking zone of the plurality of cooking zones via the user interface;

receiving a second temperature request for a second cooking zone of the plurality of cooking zones via the user interface, the second cooking zone being different from the first cooking zone and the second temperature request being different from the first temperature request;

determining a first heating pattern of the plurality of heating elements based on the first temperature request, the second temperature request, the first cooking zone, and the second cooking zone;

determining a second heating pattern of the plurality of heating elements, the second heating pattern being based on the first temperature request and omitting the second temperature request;

directing each of the plurality of heating elements according to the first heating pattern;

determining that the second temperature request has been canceled after directing each of the plurality of heating elements according to the first heating pattern; and directing each of the plurality of heating elements according to the second heating pattern after determining that the second temperature request has been canceled.

2. The cooking appliance of claim 1, wherein the first temperature request is associated with a first cooking item and the second temperature request is associated with a second cooking item.

3. The cooking appliance of claim 2, wherein determining that the second temperature request has been canceled comprises:

determining that the second cooking item has been removed from the cooking chamber.

4. The cooking appliance of claim 3, further comprising:

a sensor configured to sense one or more attributes of the cooking chamber, wherein the sensor is one of an optical sensor, an ultrasonic sensor, or a weight sensor.

5. The cooking appliance of claim 4, wherein determining that the second cooking item has been removed from the cooking chamber comprises:

detecting, via the sensor, an absence of the second cooking item within the cooking chamber.

6. The cooking appliance of claim 1, wherein the plurality of heating elements comprises:

a broil heating element provided at a top of the cooking chamber; and a bake heating element provided at a bottom of the cooking chamber.

7. The cooking appliance of claim 6, wherein the plurality of heating elements further comprises a convection heating assembly in fluid communication with the cooking chamber, the convection heating assembly comprising:

a convection fan for motivating air; and a convection heating element provided adjacent to the convection fan.

8. The cooking appliance of claim 1, wherein determining the first heating pattern comprises:

determining a first required power level of each of the plurality of heating elements;

determining a first power ratio among the plurality of heating elements; and directing each of the plurality of heating elements at the first required power level and according to the first power ratio to create a temperature ratio between the plurality of cooking zones within the cooking chamber.

9. The cooking appliance of claim 1, wherein determining the second heating pattern comprises:

determining a second required power level of each of the plurality of heating elements;

determining a second power ratio among the plurality of heating elements; and directing each of the plurality of heating elements at the second required power level and according to the second power ratio to heat the cooking chamber according to the first temperature request.

10. The cooking appliance of claim 1, wherein the cooking operation further comprises:

determining a transition heating pattern; and directing each of the plurality of heating elements according to the transition heating pattern after determining that the second temperature request has been canceled and before directing each of the plurality of heating elements according to the second heating pattern.

11. A method of operating a cooking appliance, the cooking appliance comprising a cooking chamber defining a plurality of cooking zones, a plurality of heating elements provided within the cooking chamber, and a user interface configured to receive inputs, the method comprising:

receiving a first temperature request for a first cooking zone of the plurality of cooking zones via the user interface;

receiving a second temperature request for a second cooking zone of the plurality of cooking zones via the user interface, the second cooking zone being different from the first cooking zone and the second temperature request being different from the first temperature request;

determining a first heating pattern of the plurality of heating elements based on the first temperature request, the second temperature request, the first cooking zone, and the second cooking zone;

determining a second heating pattern of the plurality of heating elements, the second heating pattern being based on the first temperature request and omitting the second temperature request;

directing each of the plurality of heating elements according to the first heating pattern;

determining that the second temperature request has been canceled after directing each of the plurality of heating elements according to the first heating pattern; and directing each of the plurality of heating elements according to the second heating pattern after determining that the second temperature request has been canceled.

12. The method of claim 11, wherein the first temperature request is associated with a first cooking item and the second temperature request is associated with a second cooking item.

13. The method of claim 12, wherein determining that the second temperature request has been canceled comprises:

determining that the second cooking item has been removed from the cooking chamber.

14. The method of claim 13, wherein the cooking appliance further comprises:

a sensor configured to sense one or more attributes of the cooking chamber, wherein the sensor is one of an optical sensor, an ultrasonic sensor, or a weight sensor.

15. The method of claim 14, wherein determining that the second cooking item has been removed from the cooking chamber comprises:

detecting, via the sensor, an absence of the second cooking item within the cooking chamber.

16. The method of claim 11, wherein the plurality of heating elements comprises:

a broil heating element provided at a top of the cooking chamber; and a bake heating element provided at a bottom of the cooking chamber.

17. The method of claim 16, wherein the plurality of heating elements further comprises a convection heating assembly in fluid communication with the cooking chamber, the convection heating assembly comprising:

a convection fan for motivating air; and a convection heating element provided adjacent to the convection fan.

18. The method of claim 11, wherein determining the first heating pattern comprises:

determining a first required power level of each of the plurality of heating elements;

determining a first power ratio among the plurality of heating elements; and directing each of the plurality of heating elements at the first required power level and according to the first power ratio to create a temperature ratio between the plurality of cooking zones within the cooking chamber.

19. The method of claim 11, wherein determining the second heating pattern comprises:

determining a second required power level of each of the plurality of heating elements;

determining a second power ratio among the plurality of heating elements; and directing each of the plurality of heating elements at the second required power level and according to the second power ratio to heat the cooking chamber according to the first temperature request.

20. The method of claim 11, further comprising:

determining a transition heating pattern; and directing each of the plurality of heating elements according to the transition heating pattern after determining that the second temperature request has been canceled and before directing each of the plurality of heating elements according to the second heating pattern.

* * * * *